US006954974B2

(12) United States Patent
Rada

(10) Patent No.: US 6,954,974 B2
(45) Date of Patent: Oct. 18, 2005

(54) METHOD OF CONSTRUCTING A RAIL TRACK ON A CONCRETE SLAB AND A TEMPORARY TIE PLATE FOR USE IN THE METHOD

(75) Inventor: Nicolas Rada, Neuilly S/Seine (FR)

(73) Assignee: Alstom, Paris (FR)

( * ) Notice: Subject to any disclaimer, the term of this patent is extended or adjusted under 35 U.S.C. 154(b) by 464 days.

(21) Appl. No.: 10/278,981

(22) Filed: Oct. 24, 2002

(65) Prior Publication Data

US 2003/0085294 A1 May 8, 2003

(30) Foreign Application Priority Data

Nov. 7, 2001 (FR) ..... 01 14400

(51) Int. Cl.[7] ..... B23P 11/00

(52) U.S. Cl. ..... 29/423; 29/464; 238/29; 238/27; 238/2; 264/33; 264/228; 264/161

(58) Field of Search ..... 29/428, 423, 436, 29/464, 466; 238/29, 27, 2, 5, 7, 25; 264/33, 264/228, 161; 249/2, 141, 97

(56) References Cited

U.S. PATENT DOCUMENTS 1,344,676 A * 6/1920 Burch ..... 238/117
3,662,952 A * 5/1972 Berks et al. ..... 238/310
4,255,104 A * 3/1981 Stinton ..... 425/111
4,616,395 A * 10/1986 Farese et al. ..... 29/460
4,730,805 A * 3/1988 Yokota et al. ..... 249/113
5,160,084 A * 11/1992 Owen et al. ..... 238/310
6,488,215 B2 * 12/2002 Mohr ..... 238/2
6,732,418 B2 * 5/2004 Rada ..... 29/428

FOREIGN PATENT DOCUMENTS

EP 0 715 021 A 6/1996
EP 1 041 201 A 10/2000

* cited by examiner

*Primary Examiner*—David P. Bryant
*Assistant Examiner*—Stephen Kenny
(74) *Attorney, Agent, or Firm*—Sughrue Mion, PLLC

(57) ABSTRACT

In a method of constructing a rail track on a concrete slab, the concrete slab is poured around anchor members for fixing tie plates supporting the rails of the rail track. The method includes the following steps: suspending the rails premounted on their tie plates above the location at which the concrete slab is to be poured, each tie plate including a base under which is disposed a temporary tie plate for accurately guiding the anchor members, adjusting the position of the rails, pouring the concrete slab up to the height of the temporary tie plates, raising the rails and removing the temporary tie plates, and accurately positioning the rails premounted on their tie plates on the concrete slab in their final position and fixing the tie plates to the anchor members.

3 Claims, 4 Drawing Sheets

METHOD OF CONSTRUCTING A RAIL TRACK ON A CONCRETE SLAB AND A TEMPORARY TIE PLATE FOR USE IN THE METHOD

BACKGROUND OF THE INVENTION

1. Field of the Invention

The invention relates to a method of constructing a rail track and in particular to a method of constructing a rail track on a concrete slab in which the concrete slab is poured around anchor members for fixing tie plates supporting the rails of the rail track. The invention also relates to a temporary tie plate used in the method according to the invention.

2. Description of the Prior Art

Laying a rail track for metros or trams on a concrete slab by placing prefabricated rails directly onto tie plates at the location where the track is to be laid, the rails being suspended in their final position by means of a gantry with the tie plates fixed to the rails by attachments, is currently known in the art. A concrete slab is then poured under the rails, up to the height of the tie plates, which support anchor members consisting of threaded rods passing through the tie plates and having a bottom part embedded in the concrete slab. When the concrete has set, the tie plates are permanently immobilized on the concrete slab by tightening nuts onto the threaded rods, the nuts bearing on the top face of the tie plates.

In the above kind of construction method, it is necessary for the threaded rods to be held perfectly perpendicular to the tie plate when pouring the concrete to assure a good seating of the tie plate during subsequent tightening of the nuts onto the threaded rods. However, it is also necessary for the threaded rods not to be rigidly attached to the tie plate so that tightening the nuts, after the concrete has set, tensions the part of the threaded rods embedded in the concrete, for good retention of the threaded rods in the concrete slab.

Solving this problem by using elastic members or fusible members to hold the threaded rods on the tie plate during pouring of the concrete and which enable movement of the threaded rods relative to the tie plate when tightening the nuts is currently known in the art.

However, the above kind of elastic or fusible members have the drawback of not ensuring that the threaded rods are correctly perpendicular to the tie plates, which leads to imperfect seating of the tie plates during subsequent tightening of the nuts.

Also, one object of the present invention is to propose a method of building a rail track that enables accurate and perpendicular positioning of anchor members relative to the tie plate when pouring the concrete and uses anchor members that are independent of the tie plates when tightening the nuts after the concrete has set.

SUMMARY OF THE INVENTION

To this end, the invention provides a method of constructing a rail track on a concrete slab, in which method the concrete slab is poured around anchor members for fixing tie plates supporting the rails of the rail track, which method includes the following steps:

suspending the rails premounted on their permanent tie plates above the location at which the concrete slab is to be poured, each permanent tie plate including a base under which is disposed a temporary tie plate for accurately guiding the anchor members of the permanent tie plate, adjusting the position of the rails to move the bottom plate of the temporary tie plates accurately to the location at which the permanent tie plates supporting the rails must rest, pouring the concrete slab up to the height of the temporary tie plates, raising the rails and removing the temporary tie plates, and accurately positioning the rails premounted on their tie plates on the concrete slab and fixing the permanent tie plates to the anchor members.

According to another feature of the invention the temporary tie plates include guide bushes engaging in close-fitting openings in the base of the permanent tie plate, the guide bushes including a close-fitting bore receiving an anchor member consisting of a threaded rod having a portion which projects beyond the bottom face of the temporary tie plate.

According to a further feature of the invention, after removing the temporary tie plates, spacers are placed inside the openings in the permanent tie plates or around the threaded rods, the spacers accurately locating the tie plates on the concrete slab by virtue of having a body with a cylindrical part inserted in the openings of the permanent tie plate whose outside diameter is a close fit to the diameter of the opening of the permanent tie plate, the cylindrical part of the body including an internal bore which is a close fit to the diameter of the threaded rod.

According to a further feature of the invention the rails are suspended above the slab to be poured by means of a gantry for moving the rails accurately to a required position.

The invention also provides a temporary tie plate adapted to be placed under a permanent tie plate supporting a rail track rail during the construction of a rail track on a concrete slab by the construction method previously described, which temporary tie plate includes guide bushes inserted in matching openings in the tie plate, the guide bushes including a close-fitting bore receiving an anchor member of the tie plate consisting of a rod having a portion which projects beyond the bottom face of the temporary tie plate in order to be embedded in the concrete slab.

In particular embodiments the temporary tie plate according to the invention can have any of the following features alone or any technically feasible combination:

it includes a body consisting of a plate with openings receiving the guide bushes;

the guide bushes include a shoulder which is inserted into a complementary cavity formed in the plate at the edge of the openings, the shoulder constituting an axial abutment;

the rods have a threaded top part projecting from the guide bushes and receiving nuts for vertically retaining the rod to the tie plate;

under the threaded top part, the rod has a local constriction providing an abutment against sliding of the guide bush.

Objects, aspects and advantages of the present invention will be understood better from the description of one particular and non-limiting embodiment of the invention given hereinafter and with reference to the accompanying drawings.

DETAILED DESCRIPTION OF THE PREFERRED EMBODIMENT

To clarify the drawings, only components necessary for understanding the invention are shown. The same components carry the same reference numbers from one figure to the other.

Figure 1:
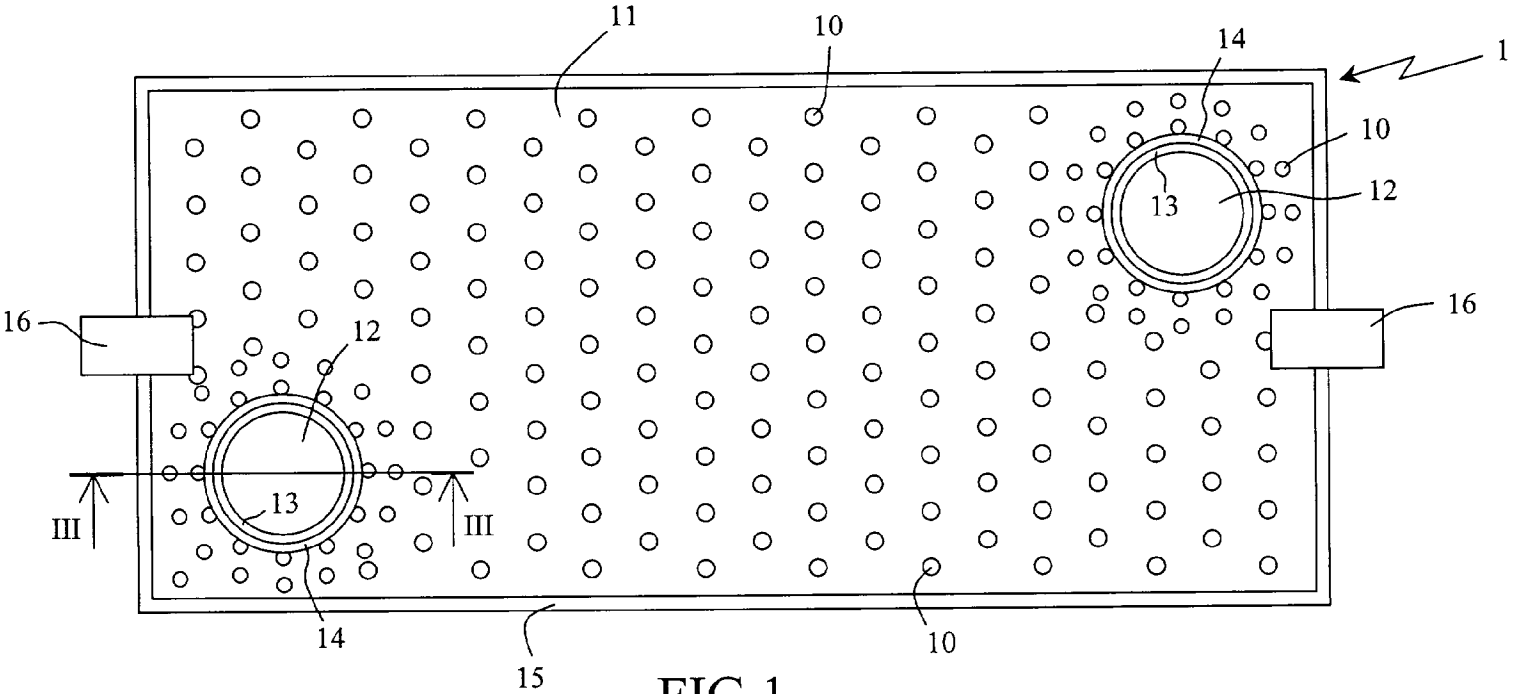
FIG. 1 is a top view of one particular embodiment of a temporary tie plate according to the invention.
Figure 2:
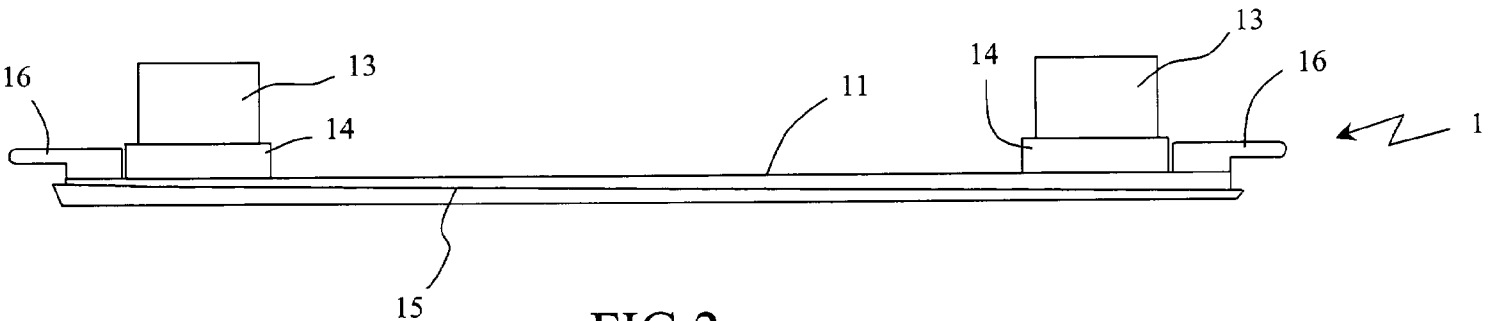
FIG. 2 is a side view of the temporary tie plate shown in FIG. 1.

FIGS. 1 and 2 show one particular embodiment of a temporary tie plate 1 according to the invention. As shown in those figures, the temporary tie plate 1 includes a body 11 formed by a rectangular metal plate having multiple vents 10 opening onto the top and bottom faces of the metal plate 11.

The plate 11 also includes two openings 12 at diagonally opposite ends of the plate 11. The openings 12 receive guide pins 13 having an outside diameter matching the diameter of the opening 12 and an internal bore adapted to receive a closely fitting threaded rod 4, not shown in FIGS. 1 and 2.

Figure 3:
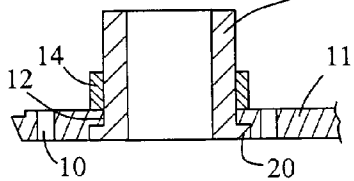
FIG. 3 is a detail view showing a section of the temporary tie plate taken along the line III—III in FIG. 1.

As shown in FIG. 3, the guide bushes 13 have in their bottom part a shoulder 20 which is inserted into a matching cavity on the bottom face of the plate 11 when the bushes are inserted into the openings 12 through the bottom face of the temporary tie plate 1.

Spreaders 14 consisting of cylindrical washers are disposed around the guide bushes 13 on the top face of the plate 11 and include an internal bore slightly larger than the outside diameter of the guide bushes 13.

The outside periphery of the plate 11 has a step 15 whose edge is beveled in the direction of the bottom face of the plate 11, the top edge of the step 15 on the longitudinal side of the plate 11 being inclined relative to the plane of the bottom face of the plate 11.

The temporary tie plate 1 also includes extractor handles 16 to facilitate holding it.

Figure 6:
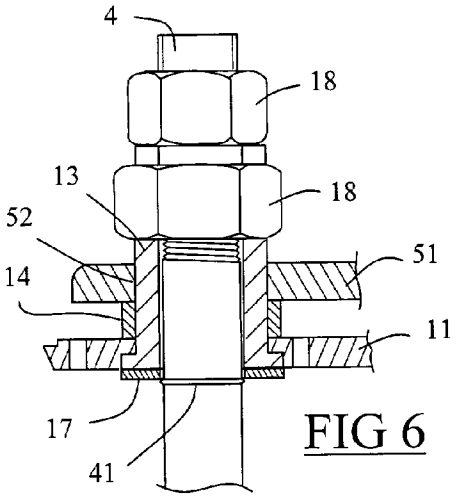
FIG. 6 is a detail view of the means for assembling the temporary tie plate to the permanent tie plate intended to support the rail.
Figure 5:
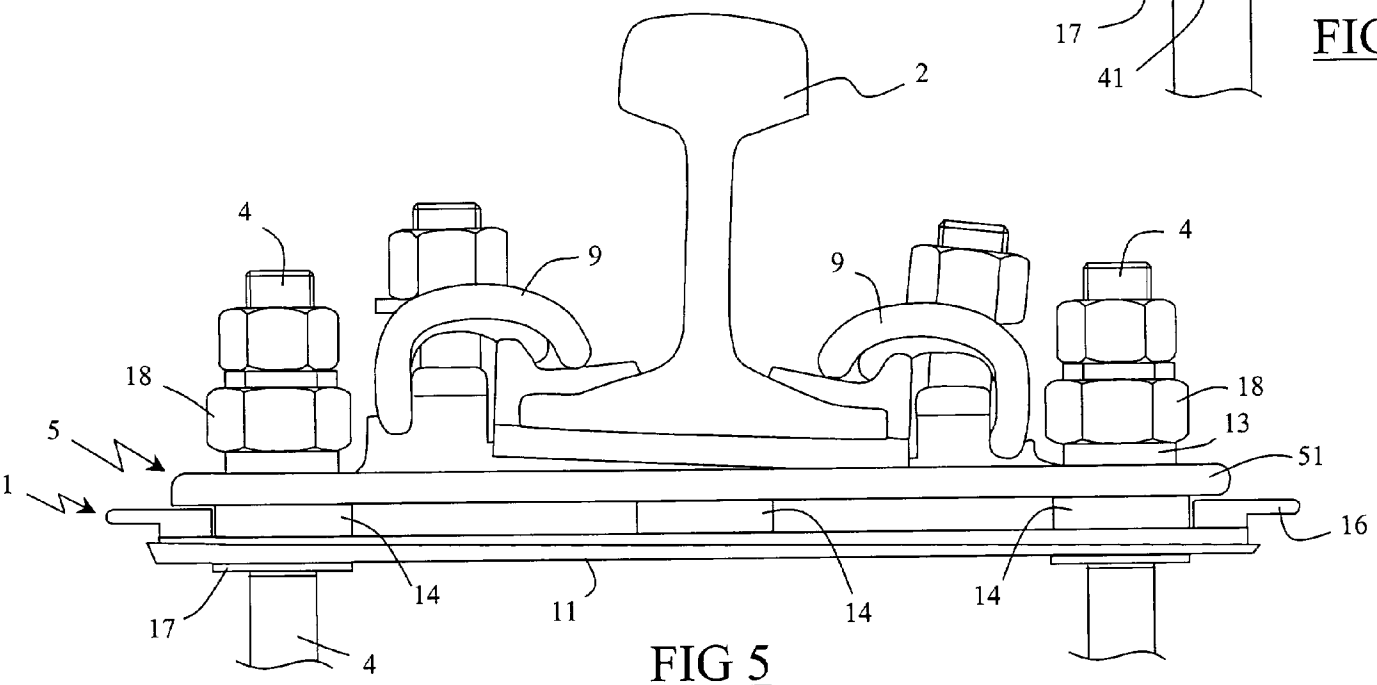
FIG. 5 is an enlarged view of one of the rails shown in FIG. 4, equipped with a temporary tie plate conforming to one particular embodiment of the construction method according to the invention.

The use of the temporary tie plate 1 previously described and the construction method in accordance with the invention are described next with reference to FIGS. 4 to 6.

Figure 4:
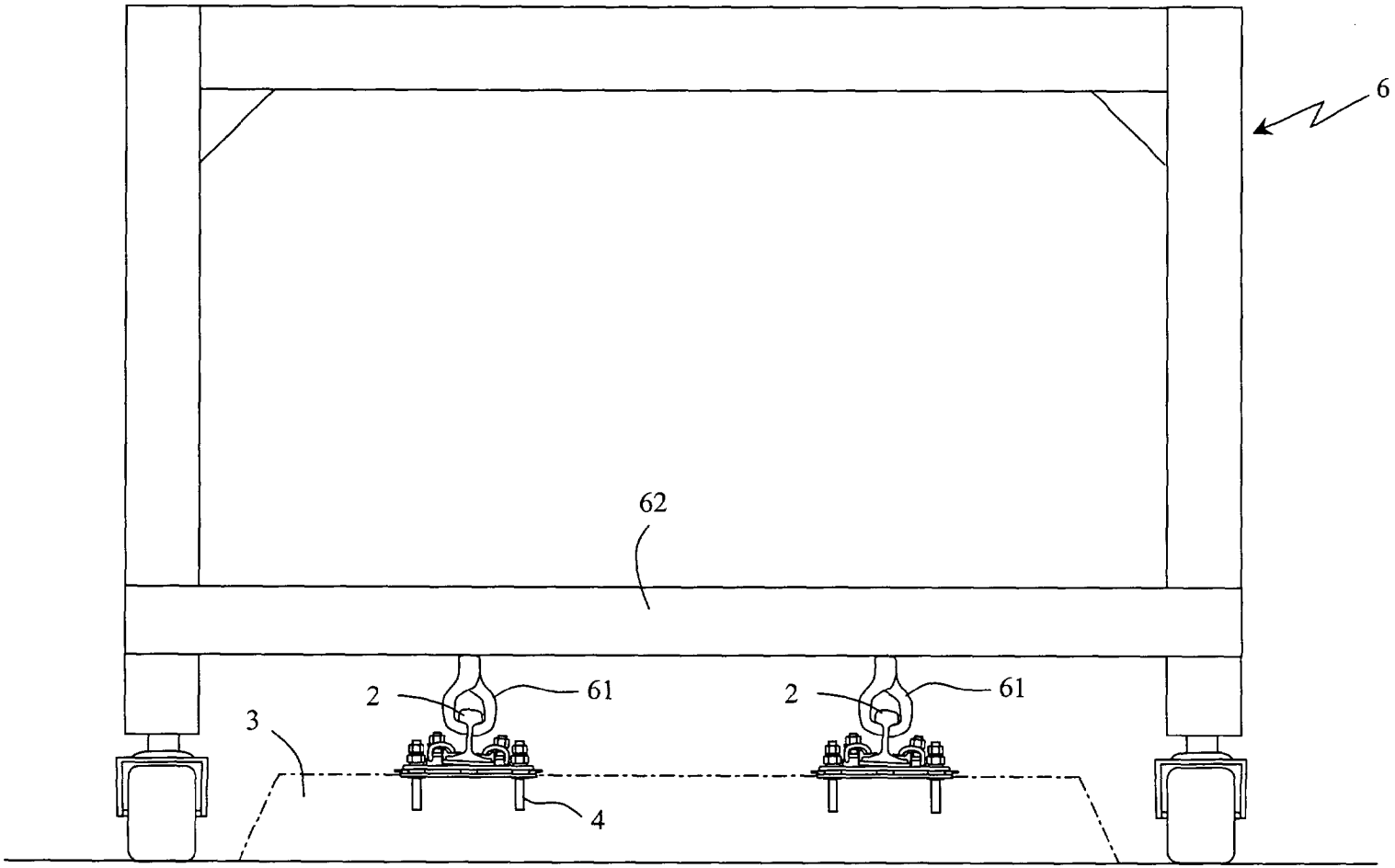
FIG. 4 is an overall view of a system for implementing a construction method according to the invention.

As shown in FIG. 4, a gantry 6 suspends two rails 2 over the place where a concrete slab 3 is to be poured. The two rails 2 are suspended by means of clamps 61 connected to a motorized beam 62 which slides vertically on the gantry 6 to move the two rails 2 precisely to the required location. As can be seen in more detail in FIGS. 5, 6 and 7, the two rails 2 are connected to tie plates 5 by attachments 9, the tie plates 5 conventionally including a base 51 consisting of a substantially solid metal plate adapted to bear on the concrete slab 3 through the intermediary of a baseplate 20, shown in FIG. 7, made of a resilient and advantageously electrically insulative material.

A temporary tie plate 1 like that previously described is placed under each of the tie plates 5 so that the guide bushes 13 supported by the temporary tie plate 1 engage in matching openings 52 in the base 51, the bottom face of the base 51 bearing on the top of the spreaders 14 supported by the temporary tie plate 1, so that a space is formed between the bottom face of the base 51 and the top face of the plate 11 of the temporary tie plate 1. The temporary tie plate 1 is held in this position under the tie plate 5 by the members for anchoring the tie plate 5 to the concrete slab 3, which here consist of threaded rods 4 inserted into the guide bushes 13 and receiving in their upper part locking nuts 18, the threaded rods 4 having a diameter slightly smaller than that of the bore in the guide bush 13 and having a local constriction 41 on which rests a washer 17 bearing on the bottom face of the guide bushes 13. The threaded rods 4 disposed in this way have a portion projecting a great distance from the bottom face of the temporary tie plates 1 and intended to be embedded in the concrete.

Before pouring the concrete slab 3, the bottom face of the temporary tie plates 1 is coated with a shuttering-release oil and the beam 62 of the gantry 6 is shifted to move the bottom face of the temporary tie plates 1 to the intended location of the bearing surfaces of the tie plates 5 for supporting the rails 2 of the track to be constructed.

A concrete slab 3, shown in chain-dotted outline in FIG. 4, is then poured up to the height of the temporary tie plates 1 and around the portion of the threaded rods 4 projecting from the bottom of the plate 11. The top surface of the concrete 3 is then smoothed so that the surface of the concrete follows the slope of the step 15 at the edge of the temporary tie plate 1, the latter indicating the required inclination of the concrete slab 3 relative to the horizontal for correct evacuation of surface water.

After a drying time to enable the concrete slab 3 to set, the nuts 18 on the threaded rods 4 are removed and the rails 2 premounted on their tie plates 5 are raised by means of the gantry 6. The temporary tie plates 1 accompanied by the guide bushes 13 and the spreaders 14 are then removed, the handles 16 facilitating the removal of the temporary tie plates 1.

Figure 7:
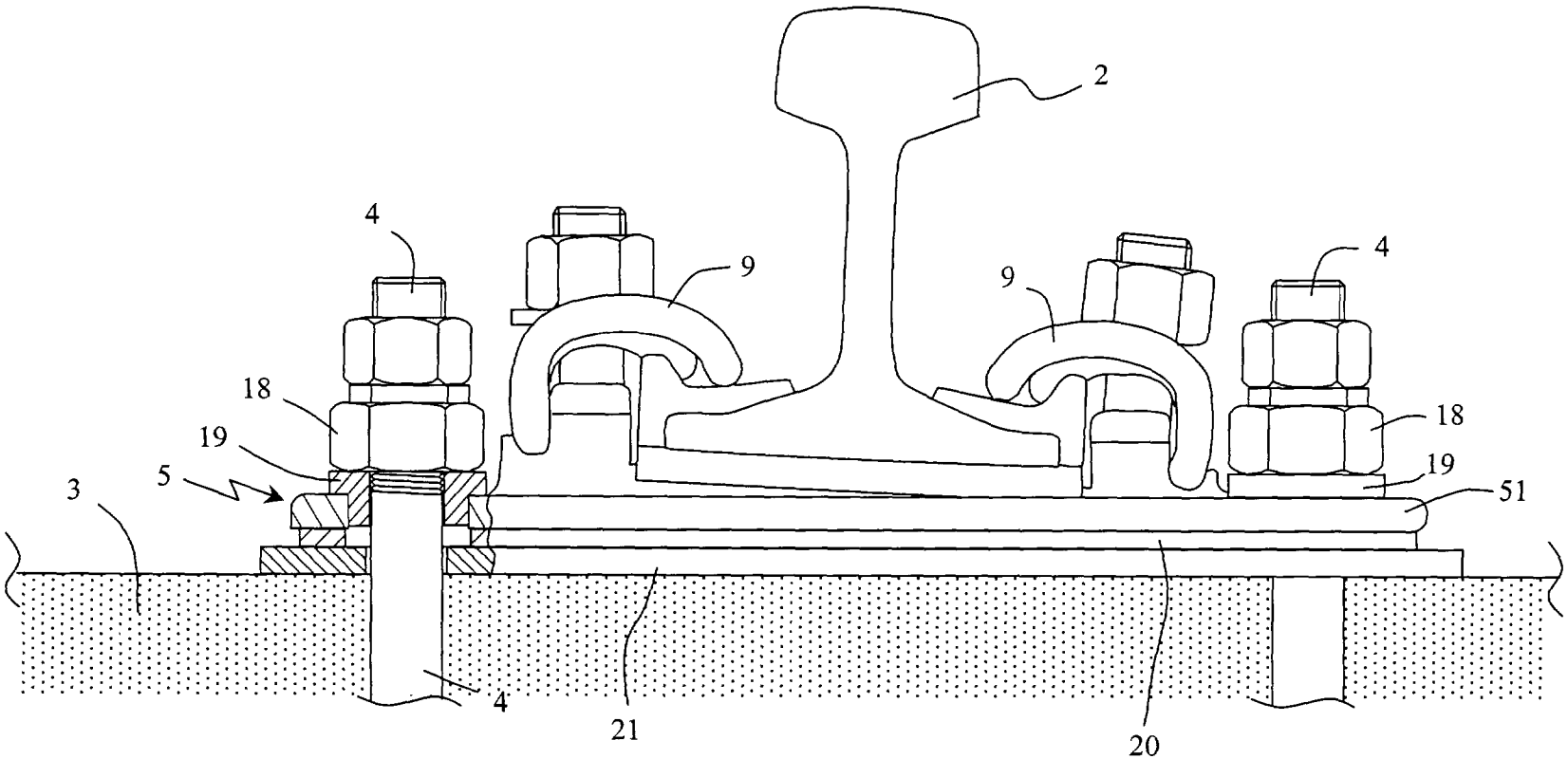
FIG. 7 is a partly sectioned side view of the permanent tie plate after it has been mounted on the concrete slab.

Electrically insulative spacers 19 shown in FIG. 7 are then placed inside the openings 52 of the tie plates 5, the insulative spacers 19 having a body with a cylindrical part inserted in the openings 52 whose inside and outside diameters are identical to the inside and outer diameters of the guide bushes 13, i.e. they are respectively a close fit to the diameter of the openings 52 and the threaded rods 4. The spacers 19 also have a flange in their top part on which the clamping nuts bear, with an optional spring, not shown in the figures, inserted between the nut and the flange of the spacer 19, the height of the spacer 19 being such that it does not project beyond the bottom face of the tie plate 5 when it is inserted in the opening 52.

The rails 2 premounted on their tie plates 5 are then lowered again, after inserting the resilient material baseplate 20 under the bottom face of the base 51, the baseplate 20 having holes in line with the threaded rods. An additional baseplate 21, which need only be electrically insulative, is advantageously placed under the previously mentioned baseplate 20, the combination being brought into contact with the concrete slab 3 by passing the threaded rods 4 projecting from the concrete slab 3 through the baseplates 20, 21 and the bores of the insulative spacers 19 disposed in the openings 52 of the tie plates 5. Because of the presence during this operation of the insulative spacers 19, which have radial dimensions similar to those of the guide bushes 13, the tie plates 5 are placed at their final position automatically and accurately.

The tie plates 5 are then immobilized in the conventional way by means of nuts 18 screwed onto the threaded rods 4, the latter bearing on the top face of the tie plate 5 through the intermediary of the flange of the insulative spacer 19.

By using temporary tie plates in accordance with the invention, the above kind of construction method achieves accurate and perpendicular positioning of the threaded rods constituting the anchors of the tie plates, thanks to the excellent guidance provided by the guide bushes. What is more, fitting insulative spacers with a template equivalent to the guide bushes after removing the temporary tie plates ensures accurate positioning of the tie plates on the concrete slab with no additional adjustment procedure.

Of course, the invention is in no way limited to the embodiment described and shown, which has been described and shown merely by way of example, and can be modified without departing from the scope of the protection afforded to the invention, in particular with regard to the composition of the various components or by substituting technical equivalents.

There is claimed:

1. A method of constructing a rail track on a concrete slab, in which method the concrete slab is poured around anchor members for fixing tie plates supporting the rails of said rail track, which method includes the following steps:

suspending said rails premounted on their tie plates above the location at which said concrete slab is to be poured, each tie plate including a base under which is disposed a temporary tie plate including guide bushes engaging in close-fitting openings in said base, said guide bushes including a close-fitting bore receiving an anchor member consisting of a threaded rod having a portion which projects beyond the bottom face of said temporary tie plate, adjusting the position of said rails to move said bottom plate of said temporary tie plates accurately to the location at which said tie plates supporting said rails must rest, pouring said concrete slab up to the height of said temporary tie plates, raising said rails and removing said temporary tie plates, and accurately positioning said rails premounted on their tie plates on said concrete slab and fixing said tie plates to said anchor members.

2. The rail track construction method claimed in claim 1, wherein, after removing said temporary tie plates, spacers are placed inside said openings in said tie plates or around said threaded rods, said spacers accurately locating said tie plates on said concrete slab by virtue of having a body with a cylindrical part inserted in said opening whose outside diameter is a close fit to the diameter of said opening, said cylindrical part including an internal bore which is a close fit to the diameter of said threaded rod.

3. The rail track construction method claimed in claim 1, wherein said rails are suspended above said slab to be poured by means of a gantry for moving said rails accurately to a required position.

* * * * *